United States Patent [19]

Kienlein et al.

[11] Patent Number: 4,523,698

[45] Date of Patent: Jun. 18, 1985

[54] BEER KEG ACCESSORIES

[75] Inventors: Kurt Kienlein, Rothenbach; Ralph D. Reese, Schwaig, both of Fed. Rep. of Germany

[73] Assignee: W. Duncan Porter, Carefree, Ariz.

[21] Appl. No.: 574,531

[22] Filed: Jan. 27, 1984

[51] Int. Cl.[3] ..... B67D 3/00

[52] U.S. Cl. ..... 222/185; 222/80; 222/545

[58] Field of Search ..... 222/80–83, 222/130, 131, 180, 181, 184, 185, 394, 502, 503, 544, 545, 573; 248/188.8, 188.9; 137/318, 320, 323

[56] References Cited

U.S. PATENT DOCUMENTS

| | | | |
|---|---|---|---|
| 251,953 | 1/1882 | Ruehe | 222/573 X |
| 275,790 | 4/1883 | Schock | 222/130 |
| 1,006,008 | 10/1911 | Ross | 222/573 X |
| 1,207,278 | 12/1916 | Cordley | 222/131 |
| 1,515,240 | 11/1924 | Cox | 222/86 |
| 1,557,861 | 10/1925 | Moreida | 222/82 |
| 2,224,514 | 12/1940 | Jung | 222/544 X |
| 3,088,631 | 5/1963 | Lien et al. | 222/81 |
| 4,173,295 | 11/1979 | Steinman | 228/81 |
| 4,200,254 | 4/1980 | Nelson | 248/188.8 |
| 4,228,929 | 10/1980 | Gross | 222/185 |
| 4,386,718 | 6/1983 | Stewart et al. | 222/185 |

FOREIGN PATENT DOCUMENTS

| | | | |
|---|---|---|---|
| 2514330 | 4/1983 | France | 222/544 |

*Primary Examiner*—Joseph J. Rolla
*Assistant Examiner*—Michael S. Huppert
*Attorney, Agent, or Firm*—Warren F. B. Lindsley

[57] ABSTRACT

Beer cock for the dual purpose of mounting in a bung hole and draining beer therefrom and for use in supporting the beer keg on a planar surface.

5 Claims, 4 Drawing Figures

BEER KEG ACCESSORIES

BACKGROUND OF THE INVENTION

This invention relates to beer kegs of the three to six liter size and more particularly to accessories for boxing, tapping and supporting the keg for use when extracting beer therefrom.

DESCRIPTION OF THE PRIOR ART

The domestic use of beer casks or kegs especially of the three to six liter size has increased as a result of the merchandising in the United States of premium quality beers manufactured abroad. Heretofore such beer kegs have required the use of not only a bung hole tapper and beer cock for extracting the beer from the keg, but also a means for injecting a source of gas under pressure into the keg for use in extracting the beer from the keg.

Since the cost of accessories needed for extracting the beer from the keg is an additional charge over the cost of the beer, this fact has discouraged buyers from purchasing beer kegs of relatively small volumes.

SUMMARY OF THE INVENTION

In accordance with the invention claimed a new, improved and inexpensively manufactured accessory is provided for not only tapping the beer keg but also aiding in supporting the beer keg in an inverted position so that atmospheric pressure may be used effectively to drain the beer from the keg when a beer cock forming a part of the accessory is opened.

It is, therefore, one object of this invention to provide a new and improved dual purpose beer cock that is used not only for tapping and withdrawing beer from the keg, but also forms at least a part of the support for the keg when inverted for dispensing purposes.

Another object of this invention is to provide such an improved beer cock formed of plastic which may be packaged with the beer keg as a throw-away item without substantially increasing the cost of the beer keg.

A further object of this invention is to provide a new accessory group for adding to a beer keg package which not only includes the improved beer cock but also a tool for opening the keg to expose its contents to atmospheric pressure.

A still further object of this invention is to provide a new and improved wrapped or packaged beer keg having accessories packaged with it which tap, vent and support the keg in its inverted beer dispensing position by tools which merely snap or clamp in place on the keg to perform their function.

Further objects and advantages of the invention will become apparent as the following description proceeds, and the features of novelty which characterize this invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
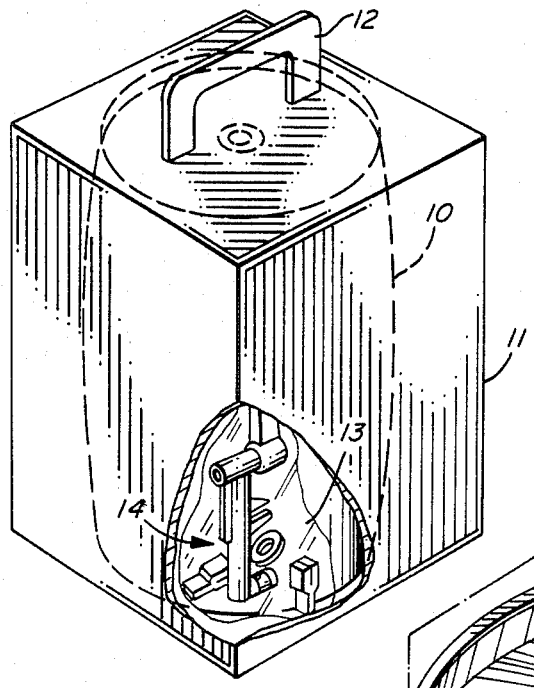
FIG. 1 is a perspective view partially broken away revealing the accessory package packed with a beer keg of three to six liters in a cardboard easily carried container.

Referring more particularly to the drawing by characters of reference, FIG. 1 discloses a sheet metal beer cask or keg 10 packaged in a cardboard box or container 11 having a handle 12 for ease in carrying. Inside of the box is stored an envelope 13 containing the accessories generally identified by the reference character 14 for opening and controlling the dispensing of beer from the keg.

Figure 2:
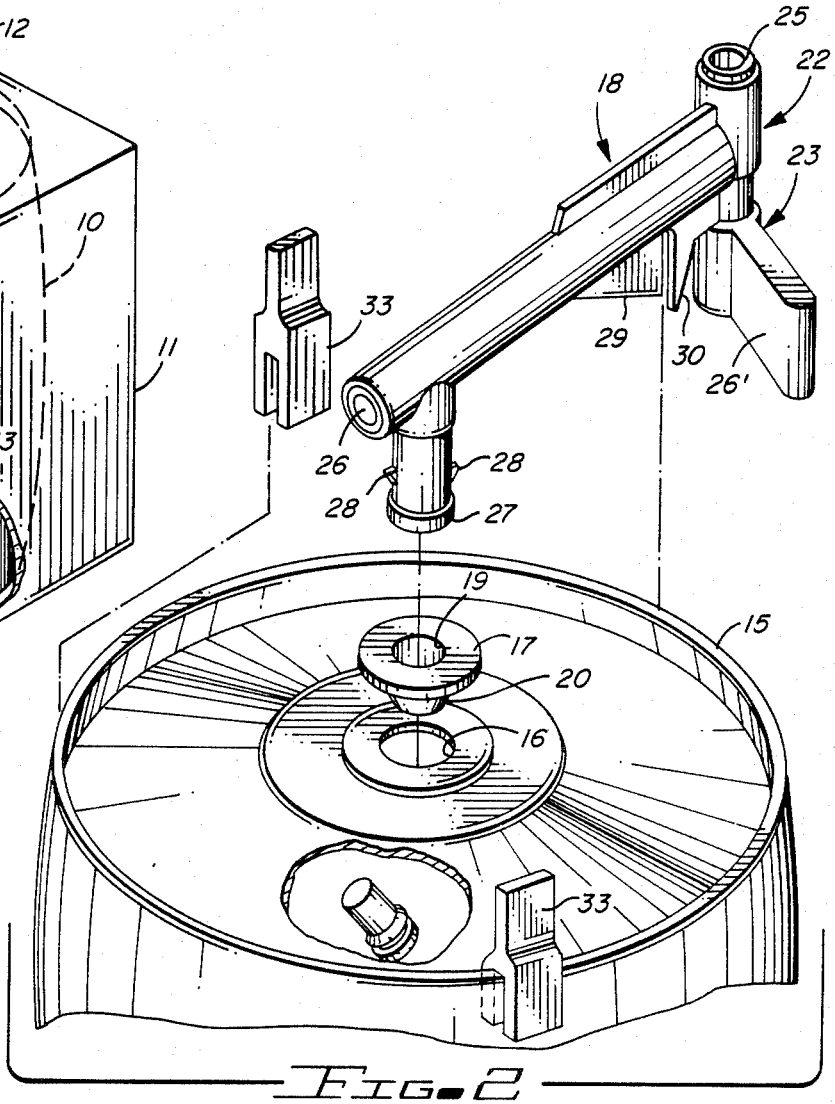
FIG. 2 is an enlarged exploded view of the top of a beer keg showing the bung hole of the keg and the tapping cock for use therewith and involving the invention.

As shown in FIG. 2 the beer cask or keg 10 comprises a sheet metal container of three to six liters having a flange 15 extending outwardly of its ends with the end shown in FIG. 2 containing a bung or extraction hole 16 sealed with a suitable known stopper 17 of elastic material after filling of the keg with beer. Such kegs can be emptied in a controlled manner by inserting in the bung hole 16 through stopper 17 a beer cock 18 which forms a part of the accessories 14 identified above.

The stopper 17 comprises a resilient member which may have an indentation 19 therein which is sealed by a plug or bung 20 in the known manner which bung is driven into the keg when the stopper is ruptured by the penetrating portion of the beer cock 18 as hereinafter explained.

The beer cock 18 comprises a plastic hollow fluid-conducting object having a tubular shaped center piece 21 which is provided adjacent one end thereof with a laterally extending pipe section 22 which is selectively placed in fluid connection with the hollow interior of piece 21 by a pet cock 23. The pipe section 22 forms an open ended housing having mounted therein a rotatable pet cock 23 serving as a valve. Pet cock 23 comprises a hollow tubular sleeve 24 which has an opening in its cylindrical surface at a point along its length such that it can be rotated in pipe section 22 for alignment with the open end of tubular center piece 21, thereby forming a passageway for fluid in tubular center piece 21 to flow through sleeve 24 and out of its open end 25. To block this flow of fluid a handle 26 formed on sleeve 24 at its end opposite to its open end 25 is rotated a predetermined distance about the longitudinal axis of sleeve 24 causing another portion of the surface of sleeve 24 to move over the opening of the end of center piece 21 to close it in a known manner.

The other closed end 26 of center piece 21 is provided with a hollow pipe extension 27 extending laterally thereof and in communication with the hollow interior of center piece 21.

Pipe extension 27 is of such a diameter that it can fit into the indentation 19 of stopper 17 and with the usual amount of force push bung 20 of stopper 17 into the keg leaving bung hole 16 sealed closed by the pipe extension 27 which frictionally adheres with the periphery of bung hole 16 in the stopper to provide a fluid-tight seal therewith. The outer surface of pipe extension 27 may be provided with one or more barbs 28 for grasping the periphery of the hole formed in stopper 17 by the removal of bung 16, the periphery of which may be contoured or ribbed for engagement with barbs 28 to aid in holding the pipe extension 27 of the beer cock in the resilient stopper in a fluid-tight arrangement therewith.

Figure 3:
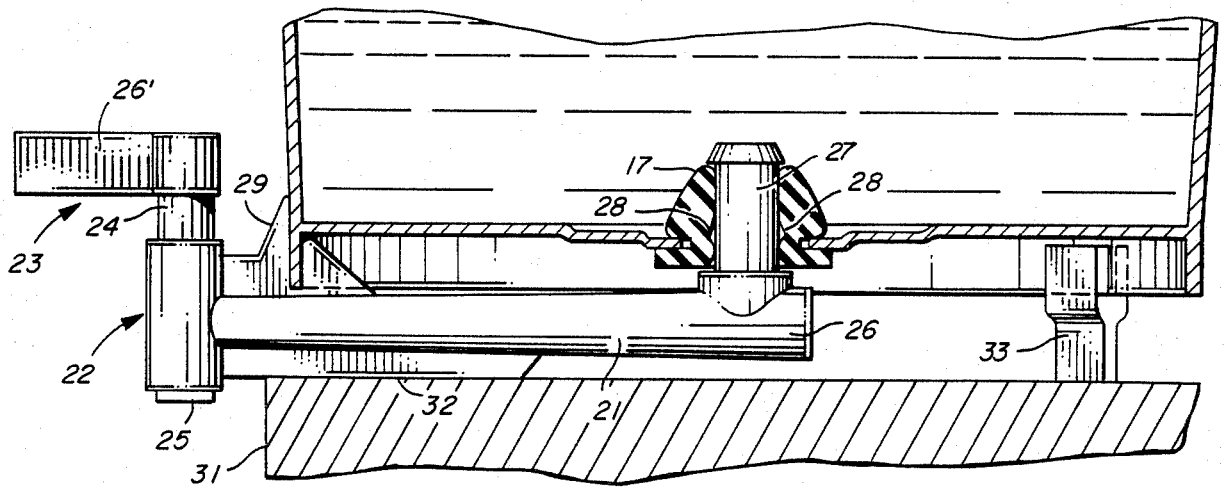
FIG. 3 is a cross-sectional view of the top of the keg shown in FIG. 2 with the keg inverted and supported on a flat surface ready for withdrawing its contents.

At a distance from the pipe extension 27 corresponding to the radius of the keg bottom, a bifurcated shaped flange 29 is secured to center piece 21 to extend laterally thereof. This flange is slotted so as to provide an opening 30 for frictionally receiving therein flange 15 of the keg when the keg is inverted as shown in FIG. 3 and the pipe extension 27 is inserted through stopper 17 of bung hole 16. This flange 29 forms one of the legs for supporting the keg when tapped, inverted and placed on a flat surface such as table 31, as shown in FIG. 3.

It should be noted that a second flange 32 is provided on the outer surface of center piece 21 to extend longitudinally and laterally outwardly thereof and diagonally of flange 29 to aid in supporting the beer cock 18 and the keg on the table. Further, flange 32 aids in maintaining flange 15 of the keg securely in position in opening 30 of flange 29.

To further aid in supporting the keg in its inverted position on a planar surface such as table 31, a pair of bifurcated legs 33 are provided as a part of accessories 14 which legs are forced over ridge 15 of keg 10 at selectively spaced position on ridge 15 of the keg to aid flanges 29 and 32 in supporting the keg on the table in a vertical position.

Figure 4:
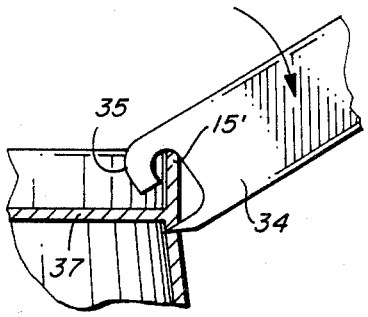
FIG. 4 is a partial view of a tool opening a sealed keg of beer to atmospheric pressure.

As shown in FIG. 4, a tool 34 is provided which may be used for puncturing a hole in the keg after it is inverted, as shown in FIG. 3, to provide atmospheric pressure on the beer in the keg to cause it to drain from the beer cock 18 when the pet cock 23 is moved to its open position.

This tool 34 which must be economically manufactured comprises a hook-shaped planar object of the size of a key formed of metal wherein the hooked end is so grooved that a hook 35 can fit over ridge 15' at the opposite end of the keg to that shown in FIGS. 2 and 3 with a pointed edge 36 thereof being positioned below ridge 15' and the end 37 of the keg in a position to punch the keg and expose its contents to atmospheric pressure. This action is used to vent the keg at one or more places so that its contents can drain from the keg through beer cock 18.

It should be noted that the tool provides a firm grip on ridge 15' and through lever action easily punches the side of the keg to provide atmospheric pressure to drain the keg rather than the expensive prior art methods of pressurizing the interior of the keg.

Thus, a simple beer cock is provided which effectively punctures the bung hole of a keg, forms a pet cock for the keg, supports the keg when placed on a center piece 21 contoured for aiding in draining all of the beer in the keg either by the force of the natural gases of the beer in the keg when the keg is agitated or by means of gravity when the keg is punctured by tool 34, and all formed of simple throw-away materials, such as plastic, metal or wood, which add little to the cost of the keg of beer.

It should be noted that the hollow interior of the centerpiece is tapered inwardly toward its open end and its longitudinal axis may extend laterally of the longitudinal axis of pipe extension 27 at an angle greater than ninety degrees to aid in draining the beer from the keg.

For effective utilization of the accessories 14 for tapping a keg, keg 10 should be set upright on a flat surface with the bung hole 16 on top thereof. The end of the pipe extension 27 is moistened to aid in pushing it into orifice 19 of stopper 17 and against bung 20. Enough force is then used to push the bung into the keg. This action causes the pipe extension to be sealed in the stopper in airtight arrangement therewith. During this action, the slot in flange 29 receives in frictional engagement therewith, flange 15 of keg 10, as shown in FIG. 3.

The handle 26 of the pet cock is then turned to the left or right until it touches the sides of the keg which action closes the pet cock.

At this point the bifurcated legs are positioned on flange 15 of keg 10 at different positions approximately 120 degrees from flange 29 of the beer cock.

The keg is now turned upside down and set on the edge of a flat surface, table, bar or the like so that a glass can be placed under the opening 25 of sleeve 24 of the pet cock. The handle 26 is now turned to open the beer cock and beer flows out of the keg.

When beer stops flowing freely, the keg may be shaken slightly which causes gas in the beer to aid in forcing the beer from the keg.

When this shaking action ceases to aid in causing the beer to flow from the keg, tool 34 is used to puncture the keg in the manner described above.

A new and improved material structure is thus provided in accordance with the stated objects of the invention. Although but a few embodiments of the invention have been illustrated and described, it will be apparent to those skilled in the art that various changes and modifications may be made therein, including numerous variations in material formulations and physical configurations without departing from the spirit of the invention or from the scope of the appended claims.

What is claimed is:

1. A cock for tapping beer kegs comprising:

an elongated hollow center piece having a length greater than the radius of an associated keg, said center piece being open at one end and closed at its other end, a first hollow pipe extension mounted to extend laterally of said center piece at its closed end and in communication with the hollow interior thereof, the other end of said first pipe extension being open ended and having means for puncturing, extending into and sealing with the bung hole of a beer keg, a second open-ended pipe extension being mounted to extend laterally of the open end of said center piece and in communication with its hollow interior, a pet cock comprising a cylindrical sleeve mounted for rotation within said second pipe extension, said sleeve having an opening therein for alignment with the open end of said center piece in one position and blocking the open end of said center piece when rotated to another position, a handle mounted on said sleeve at one end thereof for closing said sleeve and for selectively rotating said sleeve to align said opening with the open end of said center piece and to block said open end of said center piece, the other end of said sleeve being open to form with said second pipe extension a nozzle for the cock, said center piece being provided with a bifurcated first flange mounted to extend laterally thereof in the same direction as and at a distance from said first pipe extension which substantially equals the radius of a keg on which it is to be mounted and a second flange extending diagonally outwardly from said center piece in a direction opposite to said first flange for aiding in supporting the keg when associated therewith, the bifurcation of said first flange being provided for receiving therein the ridge of an associated beer keg.

2. The cock set forth in claim 1 in further combination with:

a pair of bifurcated feet each provided for receiving in the bifurcation a ridge of an associated keg on the same end as the cock when mounted thereon and spaced from each other and the cock to aid in leveling and supporting the keg on a planar surface.

3. The cock set forth in claim 2 wherein:

all of its parts are formed of plastic.

4. The cock set forth in claim 2 wherein:

all of its parts are formed of wood.

5. The cock set forth in claim 2 wherein:

all of its parts are formed of metal.

* * * * *